United States Patent [19]

Slaw, Sr.

[11] Patent Number: 4,605,336

[45] Date of Patent: Aug. 12, 1986

[54] JOINT CONSTRUCTION OF CONCRETE MEMBERS

[76] Inventor: Robert A. Slaw, Sr., Hemlock Trail, R.D. 4, Lehighton, Pa. 18235

[21] Appl. No.: 630,281

[22] Filed: Jul. 12, 1984

[51] Int. Cl.[4] ..... E01F 13/00

[52] U.S. Cl. ..... 404/6; 52/295; 52/587

[58] Field of Search ..... 52/293, 294, 236.8, 52/236.7, 583, 587, 295; 404/6, 7, 9, 13

[56] References Cited

U.S. PATENT DOCUMENTS

| | | | |
|---|---|---|---|
| 954,983 | 4/1910 | Melber | 52/583 |
| 1,982,217 | 11/1934 | Luehrs | 52/259 |
| 2,229,779 | 1/1941 | Thomas | 52/259 |
| 2,455,153 | 11/1948 | Abeles | 52/223 R |
| 3,394,522 | 7/1968 | Maurer | 52/583 |
| 3,562,979 | 2/1971 | Ali-Oglu | 52/236.8 |
| 3,803,788 | 4/1974 | Artmann | 52/587 |
| 3,812,637 | 5/1974 | Yang | 52/236.8 |
| 4,145,861 | 3/1979 | Yarnick | 52/294 |
| 4,432,176 | 2/1984 | Balzer | 52/294 |

FOREIGN PATENT DOCUMENTS

| | | | |
|---|---|---|---|
| 2425508 | 1/1980 | France | 52/259 |

*Primary Examiner*—John E. Murtagh

*Attorney, Agent, or Firm*—Thomas E. Sterling

[57] ABSTRACT

This invention relates to a structure and method of coupling a precast concrete member to a contiguous deck or other objects. The precast concrete member has a partial inwardly flaring longitudinal groove therethrough and sequential coupling rods which extend within the groove. U-shaped deck rods also extend from the deck within the groove sequentially. A locking bar is inserted longitudinally through the groove in locking relationship with the coupling rods and the U-shaped deck rods. Grout is then injected throughout the longitudinal groove and allowed to harden, thus providing a sealed and locked joint.

6 Claims, 3 Drawing Figures

JOINT CONSTRUCTION OF CONCRETE MEMBERS

This invention relates to the joining of concrete members, and more particularly to joining precast concrete members to another precast member of concrete or another substance. It may be also used to join a precast member to a poured in place concrete member or to other structural members.

Some of the current methods relative to joining precast concrete members involve:

1. Steel members cast into the precast concrete member are field-welded at the erection site.

2. A structural bolt fastened to the steel insert anchor cast into the precast concrete member.

3. A structural bolt, nut, and washer fastened through a void cast in or drilled into the precast concrete member.

Some of the disadvantages of the above systems are their high cost and their susceptibility to corrosion from exposure to weather and chemical elements, such as salt placed on roadways. This is particularly true for highway products. The present joining systems are typically precast building connections or structural steel connections, and they have been found to be unsatisfactory in some cases.

In addition the structural bolt methods require close tolerances of approximately one-eighth of an inch. The present invention operates well with tolerances of from one to four inches; hence, it is much easier, quicker and more efficient to use than the structural bolt systems.

One of the advantages of the present invention is the ability to effectively join precast units at construction sites. The precast concrete structure such as parapets, medial strips and the like can be made at a manufacturing location and transported to the construction area. Reusable steel forms may be used in the casting process to yield a superior exterior finish. In addition, the costs of producing the unit is less than a form cast at the construction site. Further, the speed of construction is increased and the procedure is made much safer for workmen.

It is therefore an object of this invention to provide an economical method and process for the coupling of precast concrete members by using the structural reinforcing steel and a series of block out voids in the concrete, which are pumped full of concrete grout after the precast member is joined to the other member.

It is also an object of this invention to make a concrete coupling or connection and process which will resist the corrosive action of weather, chemicals or the like.

It is yet another object of this invention to provide a joint made of reinforcing steel hoops, loops, hairpins or the like that are locked by another reinforcing bar or pin placed in an approximate perpendicular direction to the reinforcing steel member.

It is still another object of this invention to provide a concrete joint which is further locked by grout pressure-pumped into a void.

It is still another object of this invention to provide a process for constructing a joint using a "U-shaped" member or similar device attached to the structure and locked by a reinforcing pin or bar.

It is still another object of this invention to provide a joint and process which utilized the strength of grout plus the strength of a locking reinforcing bar.

It is yet another object of this invention to provide a joint, having a strengthening grout filled inverted wedge shaped void therein.

It is still another object of this invention to provide a joint and process which may be used for parapet anchorage, for curbing, or median barriers to deck jointures, for precast panel or wall jointures, and for roof to wall or top of vault jointures.

It is still another object of this invention to provide a joint with a void of various cross sectional shapes extending longitudinally therethrough.

It is still another object of this invention to provide a joint which may be locked by pre-stressed or post tensioned cable, wire, rod, or the like.

It is still another object of this invention to provide a joint and process which may be used to join precast concrete to structures other than concrete.

These and other objects of the invention are set forth in conjunction with the accompanying specification, claims and drawings in which:

Figure 1:
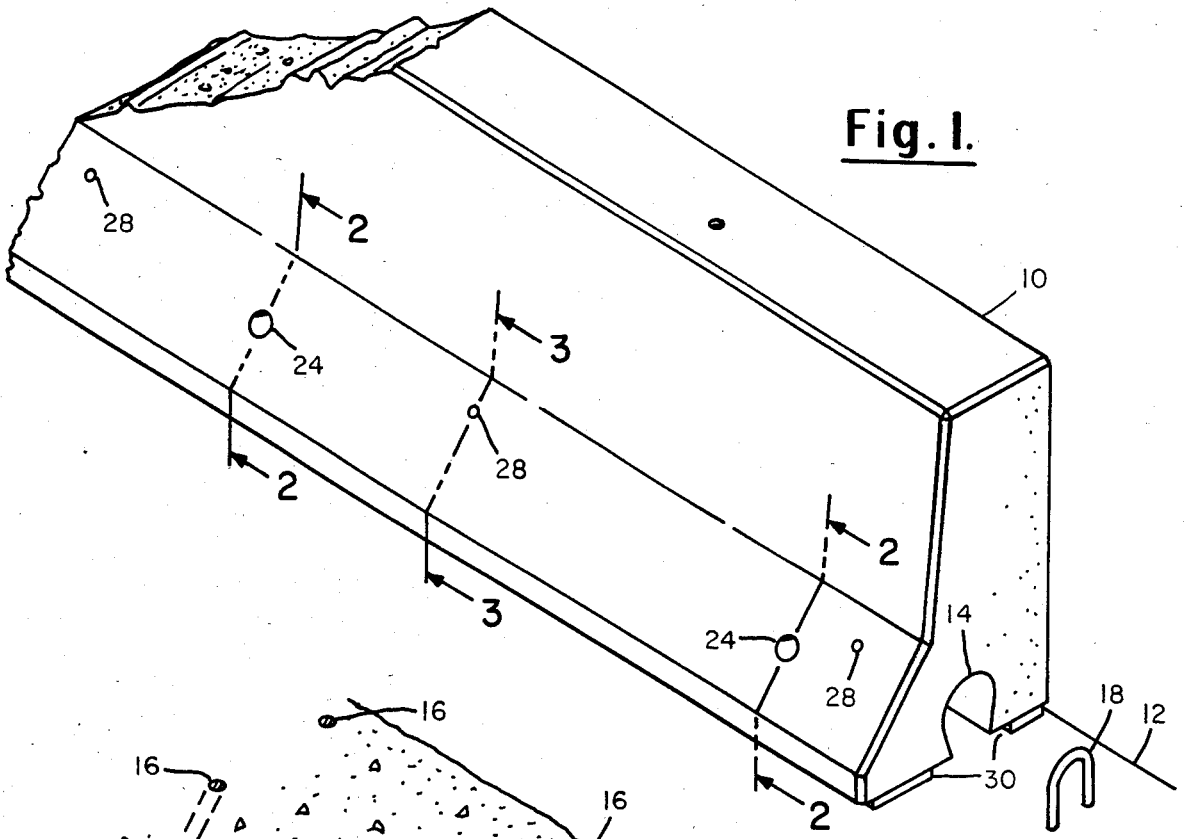
FIG. 1, is a perspective and third-dimensional view of the joint of this invention, partially in section, showing a typical parapet joined to a bridge deck.
Figure 2:
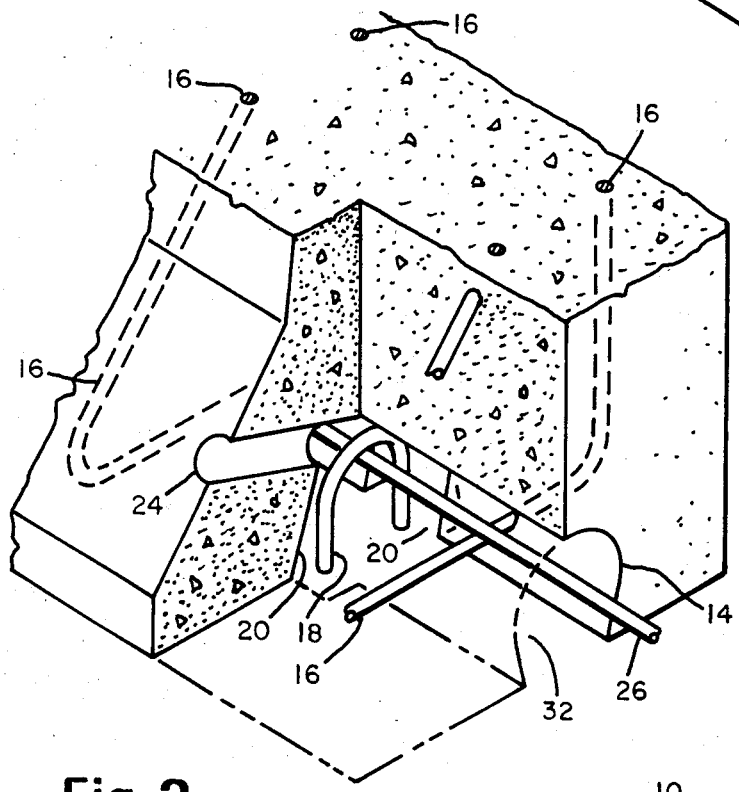
FIG. 2, is a third-dimensional view of the end portion of the parapet of FIG. 1, partially in section, along lines 2—2 of FIG. 1.
Figure 3:
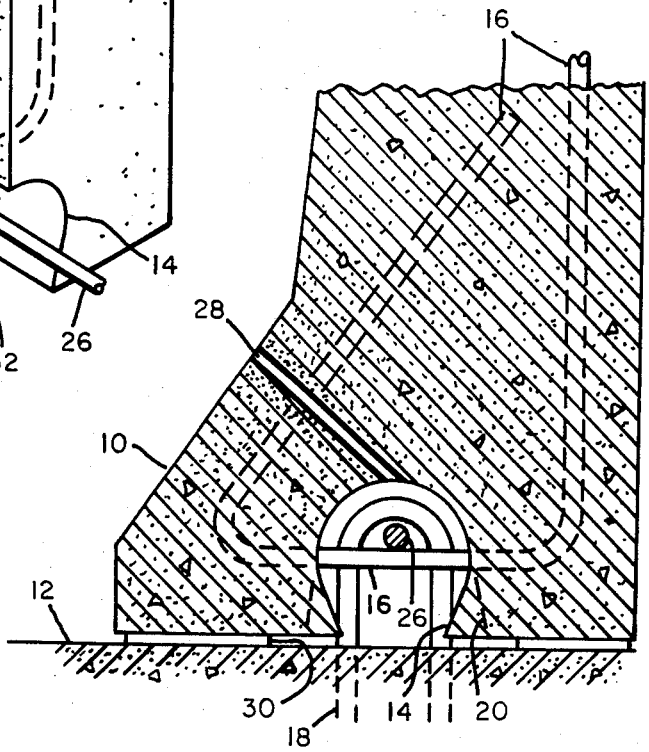
FIG. 3, is a cross-sectional view taken along line 3—3 of FIG. 1.

Referring to the drawings and in particular to FIG. 1, 10 represents a precast concrete parapet positioned on top of a conventional concrete deck 12. A tunnel-like opening extends longitudinally through the bottom portion of parapet 10 directly adjacent to the concrete deck 12. The first portion of said opening is comprised of an inwardly flaring void 14, immediately followed by an outwardly flaring void 20. This sequence repeats itself throughout the length of parapet 10.

Parapet reinforcing bars 16 are cast within the parapet 10 and extend horizontally through each section of the inwardly flaring void 14. U-shaped deck reinforcing bars 18 are cast within concrete deck 12 and extend upwardly in a looped fashion within each section of the outwardly flaring voids 20. The upper portion of the U-shaped reinforcing bars 18 is generally positioned above the parapet reinforcing bars 16. Grout inlet holes 24 extend from the lateral surface of parapet 10 to the outwardly flaring voids 20 and are used to pump grout into outwardly flaring voids 20 and inwardly flaring voids 14 after the joint has been secured. Air vent holes 28 extend from the lateral surface of parapet 10 to each section of the inwardly flaring voids 14. These air vent holes 28 allow the air to be expelled from the inwardly flaring voids 14 when grout is pumped in. It should be noted that air vent holes 28 may be completely omitted without departing from the concept of the invention. In such case air within the internal voids will be expelled through grout inlet holes 24 or through the voids themselves when the grout is pumped in. Both grout inlet holes 24 and air vent holes 28 may be positioned only at the front and rear end portions of the parapet 10 or at intervals along the length of parapet 10. They may be positioned at each inwardly flaring void 14 and outwardly flaring void 20 as well.

In operation, parapet 10 is aligned on deck 12 with reinforcing bars 18 extending within outwardly flaring voids 20. The outwardly flaring shape of void 20 assists the positioning and alignment of deck reinforcing bars 18. A locking bar 26 is then inserted through inwardly flaring voids 14 and outwardly flaring voids 20 so as to pass above parapet reinforcing bars 16 and below deck reinforcing bars 18. The parapet 10 is thus locked to the deck 12 by locking bar 26. The tolerance between the locking bar 26 and the parapet reinforcing bars 16 or the deck reinforcing bars 18 may be from one to four inches. It should be noted that locking bar 26 is usually comprised of a reinforcing steel rod, commonly used in concrete construction. However, locking bar 26 could be a pre-stressed cable, post tensioned cable, a utility conduit or other bar-type devices. When the post tensioned cable method is used, the cable is inserted, grout pumped in, the cable then put under tension, and the grout allowed to harden. Likewise parapet reinforcing bars 16 and deck reinforcing bars 18 could ultimately be replaced by other types of common fasteners such as hook bolts, eye bolts, plates or other types of loops or hooks. In addition, inwardly flaring voids 14 and outwardly flaring voids 20 could perform specialized functions, such as centering the precast parapet unit 10 and as a receptacle for outlets, conduits and the like.

After locking bar 26 has been positioned within inwardly flaring voids 14 and outwardly flaring voids 20 a grout mixture under pressure is forced into grout inlet holes 24 until the entire length of inwardly flaring voids 14 and outwardly flaring voids 20 are filled with grout. The air vent holes 28 allow the expulsion of air from voids 14 and 20 while the plastic grout is being forced therethrough. Likewise the unused grout inlet holes 24 serve the same purpose.

When all inwardly flaring voids 14, outwardly flaring voids 20, grout inlet holes 24 and air vent holes 28 have been filled with grout, the internal portion of parapet 10 is completely sealed from the outside atmosphere or corrosive elements. Hence, parapet reinforcing bars 16, deck reinforcing bars 18 and locking bars 26 will not readily rust or deteriorate from contact with the atmosphere, outside road chemicals, or the like.

It should be noted that when the grout has hardened within inwardly flaring joints 14, the grout increases the strength of the joint which is now secured by locking bar 26 and by hardened grout.

This invention is designed to transfer compression-tension or shear or a combination of both. The joint of this invention does not depend on grout strength alone but uses the strength of the grout plus the strength of locking bar 26.

Although this invention has been described in terms of anchoring a parapet to a deck, it should be understood that it may be used to anchor a curb to a deck, a medium barrier to deck jointures, precast wall panels or wall jointers may also be locked together. Likewise the invention may be used to join a roof to a wall or a top vault and has other similar purposes. The process of the present invention comprise the steps of:

(1) Placing a concrete element containing extending fastening members on a precast base element containing fastening members;

(2) Inserting a locking bar element between the concrete element fastening members and the base element fastening members so as to lock them together;

(3) Forcing a plastic into the joint containing the fastening members of the concrete element and the fastening members of the base element; and (4) Allowing said plastic to harden, enclosing and sealing all elements.

Although this invention has been described with a degree of particularity, it is understood that numerous modifications may be made in its function and design without departing from the spirit of the invention.

I claim:

1. A union for concrete units intended to be used to couple a precast concrete parapet to a substantially flat concrete roadway surface, comprising in combination:

a precast concrete parapet having a substantially longitudinal horizontal groove therethrough;

a substantially flat concrete roadway contiguous to said precast concrete parapet, said longitudinal groove being adjacent to said concrete roadway;

a first coupling member extending from said precast concrete parapet to within said longitudinal groove;

a second coupling member extending from said concrete roadway to within said longitudinal groove;

a locking rod positioned in coupling relationship with said first coupling member and said second coupling member;

pressure pumped concrete grout compound within said longitudinal groove enclosing said first coupling member, said second coupling member and said locking rod;

a portion of said longitudinal horizontal groove adjacent to said second coupling member having an outwardly flaring wedged shaped cross chamber section;

a portion of said longitudinal groove adjacent to said first coupling member having an inwardly flaring wedged shaped cross member section.

2. The combination as claimed in claim 1, having a plurality of first coupling members and a plurality of second coupling members alternately positioned within said longitudinal groove.

3. The combination as claimed in claim 2, in which said locking rod is comprised of a concrete reinforcing rod.

4. The combination as claimed in claim 3, in which said locking rod is comprised of a prestressed cable.

5. The combination as claimed in claim 4, in which said precast concrete parapet has a grout inlet hole connected with said longitudinal groove and an air vent hole connected to said longitudinal groove.

6. The combination as claimed in claim 5, in which said air vent hole is connected to said inwardly flaring wedged shaped cross chamber section and said grout inlet hole is connected to said outwardly flaring wedged shaped cross chamber section.

* * * * *